US005269411A

United States Patent [19]

Hong

[11] Patent Number: 5,269,411

[45] Date of Patent: Dec. 14, 1993

[54] GOLF CLUB HOLDER

[76] Inventor: Bum K. Hong, 105-903, Hyundai first APT, 653 Gaepo-dong, Kangnam-gu, Seoul, Rep. of Korea

[21] Appl. No.: 875,611

[22] Filed: Apr. 28, 1992

[30] Foreign Application Priority Data

May 20, 1991 [KR] Rep. of Korea ..... 91-7177

[51] Int. Cl.[5] ..... A63B 55/00

[52] U.S. Cl. ..... 206/315.6; 206/315.2

[58] Field of Search ..... 206/315.6, 315.2, 315.5; 280/DIG. 6, 37; 211/70.2

[56] References Cited

U.S. PATENT DOCUMENTS

| | | | |
|---|---|---|---|
| 2,253,008 | 8/1941 | Anderson, Jr. | 206/315.2 X |
| 2,520,226 | 8/1950 | Smith | 206/315.5 X |
| 2,726,874 | 12/1955 | Sullivan | 280/37 |
| 3,147,022 | 9/1964 | Amendola | 280/37 |
| 3,204,976 | 9/1965 | Sprigley | 280/37 |
| 3,738,677 | 6/1973 | Renock | 280/37 |
| 4,136,724 | 1/1979 | Leitzel | 206/315.6 X |
| 4,836,565 | 6/1989 | Catalo | 280/37 |
| 5,071,147 | 12/1991 | Stansbury | 206/315.6 X |

FOREIGN PATENT DOCUMENTS

| | | | |
|---|---|---|---|
| 214555 | 8/1967 | Sweden | 206/315.5 |
| 1038401 | 8/1966 | United Kingdom | 206/315.2 |
| 1295246 | 11/1972 | United Kingdom | 206/315.2 |

*Primary Examiner*—Sue A. Weaver

*Attorney, Agent, or Firm*—Lowe, Price, LeBlanc & Becker

[57] ABSTRACT

A golf club holder capable of supporting a plurality of inverted and non-inverted golf clubs. The golf club holder includes spaced apart front and rear walls which define a chamber therebetween, for receiving shaft and grip portions of inverted golf clubs. A horizontal upper support plate is mounted to upper ends of the front and rear walls and is adapted for supporting the head of the inverted golf clubs. A plurality of laterally spaced vertical partitions are mounted to the horizontal support plate which partitions define a plurality of compartments for receiving and protecting the heads of inverted golf clubs. A plurality of openings are formed in the horizontal support plate in the compartments. Each opening allows access of a shaft and grip portions of each inverted golf club to the chamber.

1 Claim, 1 Drawing Sheet

GOLF CLUB HOLDER

TECHNICAL FIELD

The present invention relates to a golf club holder, and more particularly to a golf club holder which has a plurality of compartments, each for receiving a head of a golf club to protect the head at an upper end thereof, and plurality of compartments each for receiving a head of a golf club to protect the head at a lower end thereof, thereby safely securing the heads of golf clubs and allowing the golf clubs to be easily taken out of the golf club holder during a golf game.

DESCRIPTION OF THE PRIOR ART

Since a conventional golf bag generally receives a plurality of golf clubs in such a manner that heads of the golf clubs are simply supported together on a bottom of the golf bag, it is liable for the expensive heads of the golf clubs to come into contact with one another and become scratched and thus damaged. Furthermore, since the golf bag receives inverted golf clubs therein so that only the head portions of the golf clubs are upwardly and outwardly exposed from the golf bag, it is difficult to locate and take a desired golf club out of the golf bag.

In order to overcome the problems encountered in the prior art, methods have been proposed in which each of the heads of the golf clubs is formed with a mark at a surface thereof or is covered with an additional protecting head cover colored by a color distinguishable from others, thereby preventing the heads from contacting one another and also allowing a desired golf club to be easily located and taken out of the golf bag.

However, these methods have other disadvantages. For example, where each of the heads of the golf clubs is covered with a head cover, it is troublesome to take off the head cover from the head of the golf club after the golf club is taken out of the golf bag. In addition, since a plurality of golf clubs are inserted in a golf bag in such a manner that the heavy portions of the golf clubs, that is, the head portions of golf clubs are located above an upper portion of the golf bag, the golf bag becomes unstable when stood up on the ground and thus easily falls over even by the slightest external force.

SUMMARY OF THE INVENTION

The present invention has been made in view of the above-described prior art problems. Accordingly, one object of the invention is to provide a golf club holder which has a plurality of compartments, each for receiving a head of a golf club at an upper end thereof, and a plurality of compartments each for receiving a head of a golf club at a lower end thereof, thereby safely securing the heads of the golf clubs and allowing the golf clubs to be easily taken out of the golf bag during a golf game.

In accordance with the present invention, the object mentioned above is accomplished by providing a golf club holder comprising a vertical front wall, a vertical rear wall spaced apart from the front wall, a first golf club support means for supporting a plurality of golf clubs which extend vertically and are parallel to one another, and a second golf club support means for supporting a plurality of inverted golf clubs which extend vertically and are parallel to one another. The first golf club support means is provided at a front surface of the front wall and includes a plurality of laterally arranged chambers provided at a lower end of the front surface which are adapted to receive heads of the golf clubs. A plurality of laterally aligned holders are attached to a middle portion of the front surface of the front wall and are adapted to hold shaft portions of the golf clubs. The second golf club support means includes a single chamber defined between the front and rear walls which is adapted to receive shaft and grip portions of the inverted golf clubs. A horizontal support plate is mounted by a lower surface thereof to upper ends of the front and rear walls. The horizontal support plate extends from the upper end of the rear wall beyond the upper end of the front wall. The horizontal support plate is adapted to support heads of the inverted golf clubs. A plurality of laterally spaced vertical partitions are mounted at lower ends thereof to an upper surface of the horizontal support plate and define a plurality of compartments for receiving and protecting the heads of the inverted golf clubs. A plurality of openings are formed in the horizontal support plate within the compartments, which are adapted to allow access of the shaft and grip portions of each of the inverted golf clubs to each individual chamber.

BRIEF DESCRIPTION OF DRAWINGS

These and other objects, features and advantages of the present invention will become more apparent upon a reading of the following detailed specification and drawings, in which.

DETAILED DESCRIPTION OF THE PREFERRED EMBODIMENTS

Figure 1:
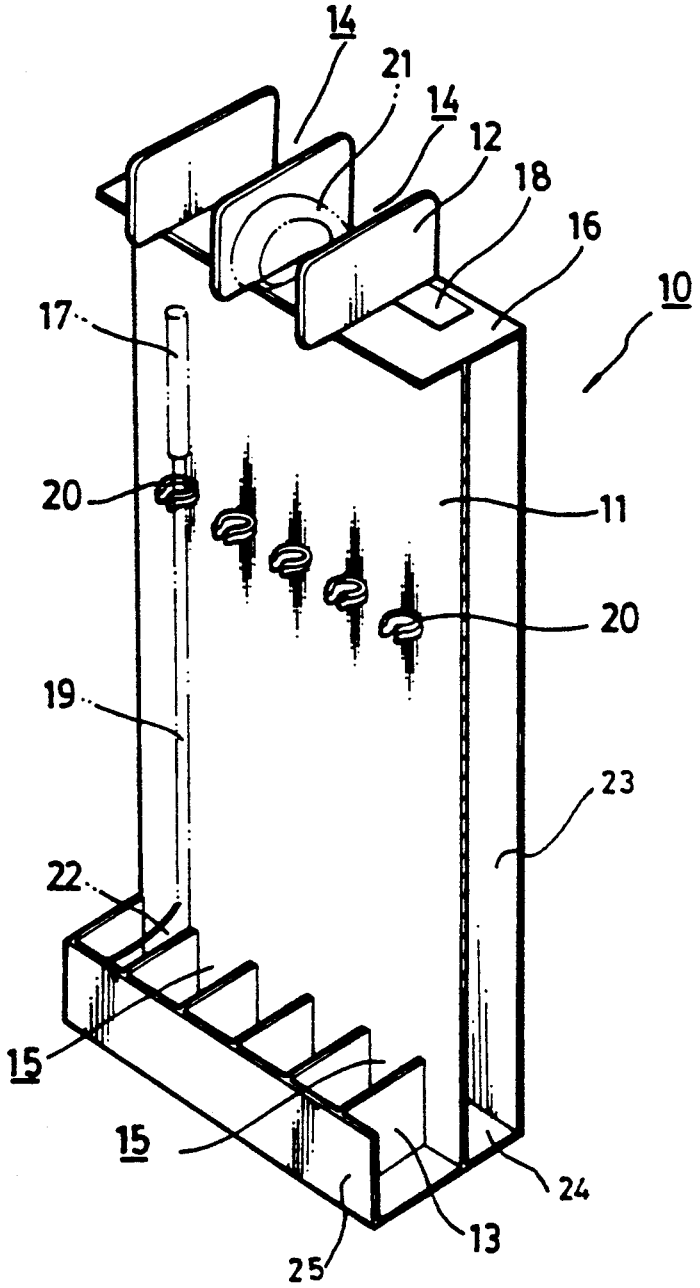
FIG. 1 is a perspective view, partly broken away to show interior construction, of a golf club holder according to the present invention.

The present invention will now be described by referring to FIG. 1 in the accompanying drawing.

Referring to FIG. 1, there is shown a structure of a golf club holder according to an embodiment of the present invention. As may be seen in FIG. 1, the golf club holder 10 comprises a vertical rear wall 23 and vertical front wall 11 spaced apart from the rear wall 23 by a predetermined distance. A horizontal upper support plate 16 is mounted to upper ends of the front and rear walls 11 and 23 as shown in FIG. 1 so as to support the heads of a plurality of inverted golf clubs. The horizontal upper support plate 16 extends forwardly from the upper end of the rear wall 23 and beyond the upper end of the front wall 11. A horizontal lower support plate 24 is mounted to lower ends of the front and rear walls 11 and 23 so as to support the heads of a plurality of golf clubs. The horizontal lower support plate 24 extends forwardly from the lower end of the rear wall 23 beyond the lower end of the front wall 11 as shown.

The upper horizontal support plate 16 is provided with a plurality of vertical partitions 12 which are arranged parallel to one another so as to define a plurality laterally arranged upper compartments 14 each for receiving a head 21 of each inverted golf club therein. The partitions 12 are arranged such that the width of each upper compartment 14 is larger than that of the head 21 of golf club. A plurality of openings 18 are formed in the upper support plate and within the upper compartments 14. Each opening 18 is adapted to allow access of the grip and shaft portions of each inverted golf club to a chamber defined between the front and rear walls 11 and 23. Grip and shaft portions of inverted golf clubs are therefore, inserted in the chamber defined between the front and rear walls 11 and 23 through the openings 18 and then suspended in the chamber while the golf club heads 21 are supported by the plate 16 in the upper compartments 14. Accordingly, the heads 21 of the inverted golf clubs can be safely kept in the upper compartments 14 respectively without contacting one another.

At the front of the front wall 11, a plurality of vertical partitions 13 are mounted to the lower horizontal support plate 24. A plate 25 extends upwardly from the front end of the lower support plate 24. By this structure, a plurality of laterally arranged lower compartments 15 are defined, in which heads 22 of golf clubs, which are non-inverted, are received.

The front wall 11 is provided at its front surface laterally aligned with a plurality of elastic holders 20 for gripping shaft portions 19 of non-inverted golf clubs. Each holder 20 is positioned at a proper height from the lower horizontal support plate 24 and is aligned with a central line each corresponding lower compartment 15. Accordingly, the heads 22 of the golf clubs can be safely kept in the lower compartments 15 and detachably gripped by the holders 20 at their shaft portions 19 below grip portions 17.

Operations of the golf bag mentioned above will be described hereinafter.

When golf clubs are to be supported in their inverted state in the golf club holder, the grip portion of each golf club is dropped into the chamber defined between the front and rear walls 11 and 23 through the openings 18 provided within each upper compartment 14. Accordingly, each golf club can be kept such that its head 21 is supported on the upper horizontal support plate 16 and its shaft and grip portions are suspended in the chamber defined between the front and rear walls 11 and 23. Each golf club can be easily taken out of the golf club holder 10 by gripping a toe portion of the golf club head 21 as gripped by user's fingers and then raising the club upwardly.

When golf clubs are to be supported in their non-inverted state in the golf club holder, the head 22 of each golf club is received in each lower compartment 15 and then the shaft portion 19 of the golf club is forced to be snapped into each corresponding holder 20. At the same time, both ends of the holder 20 are opened by pressure of the shaft portion 19 of the golf club and then restored to original position by virtue of its elasticity. Each golf club can be, therefore, kept in lower compartment 15 at its head 22 and fixedly gripped in each holder 20 at the shaft portion 19. Each golf club can also be taken out of the golf club holder 10 by detaching its shaft portion 19 from its respective holder 20 and then raising it outwardly by user's hand.

As is apparent from the above description, the golf club holder according to the present invention has a plurality of upper compartments formed by parallel partitions at an upper end thereof and a plurality of lower compartments formed by parallel partitions at a lower end thereof. Since golf club heads are individually received in the compartments, they are prevented from coming into contact with one another and thus from being damaged. In addition, if marks, each corresponding to each of golf clubs are attached to the holder respectively, user can easily find and take a desired golf club out of the golf bag during a golf game.

Although a preferred embodiment of the invention has been disclosed for illustrative purposes, those skilled in the art will appreciate that various modifications, additions and substitutions are possible, without departing from the scope and spirit of the invention as disclosed in the accompanying claim.

What is claimed is:

1. A golf club holder which comprises:

a vertical front wall, a vertical rear wall spaced apart from said front wall, a first golf club support means for supporting a plurality of non-inverted golf clubs extending vertically and parallel to one another, and a second golf club support means for supporting a plurality of inverted golf clubs extending vertically and parallel to one another, said first golf club support means being provided at a front surface of the front wall and comprising a plurality of laterally arranged compartments provided at a lower end of the front surface and adapted to receive heads of golf clubs, and a plurality of laterally arranged holders attached to a middle portion of the front surface and adapted to hold shaft portions of the golf clubs, said second golf club support means comprising:

a single unobstructed chamber defined between the front and rear walls and adapted to receive shaft and grip portions of inverted golf clubs;

a horizontal support plate mounted at a lower surface thereof to upper ends of the front and rear walls and extending forwardly from said upper end of the rear wall beyond said upper end of the front wall, said horizontal support plate being adapted to support heads of the inverted golf clubs;

a plurality of laterally spaced planar vertical partitions mounted at lower ends thereof to an upper surface of the horizontal support plate and adapted to define a plurality of compartments for receiving heads of the inverted golf clubs to protect them; and a plurality of openings formed in the horizontal support plate within said compartments, each of said openings being adapted to allow access of the shaft and grip portions of each inverted golf club to said single chamber.

* * * * *